US009511781B2

(12) United States Patent
Pettibone

(10) Patent No.: US 9,511,781 B2
(45) Date of Patent: Dec. 6, 2016

(54) RAIL CAR COVER SYSTEM

(75) Inventor: Walter Mark Pettibone, Littleton, CO (US)

(73) Assignee: Clearrails, LLC, Littleton, CO (US)

( * ) Notice: Subject to any disclaimer, the term of this patent is extended or adjusted under 35 U.S.C. 154(b) by 144 days.

(21) Appl. No.: 13/029,716

(22) Filed: Feb. 17, 2011

(65) Prior Publication Data

US 2016/0194010 A1 Jul. 7, 2016

Related U.S. Application Data

(63) Continuation of application No. 12/755,925, filed on Apr. 7, 2010, now abandoned, which is a continuation of application No. 12/632,649, filed on Dec. 7, 2009, now abandoned.

(60) Provisional application No. 61/249,561, filed on Oct. 7, 2009.

(51) Int. Cl.
*B61D 39/00* (2006.01)

(52) U.S. Cl.
CPC ..... *B61D 39/002* (2013.01)

(58) Field of Classification Search
CPC ..... B60J 7/062; B60J 7/085; B61D 39/00; B61D 39/002; B61D 39/003
USPC ..... 105/377.01, 377.02, 377.03, 377.04,105/377.06, 377.09, 377.1; 296/100.01, 100.03, 296/100.05, 100.11–100.14
See application file for complete search history.

(56) References Cited

U.S. PATENT DOCUMENTS

| | | | | |
|---|---|---|---|---|
| 337,831 | A | 3/1886 | Good | |
| 555,971 | A | 3/1896 | Richards | |
| 1,015,146 | A | 1/1912 | Davis | |
| 1,099,361 | A | 6/1914 | Hartland | |
| 2,201,737 | A | 5/1940 | Meyer et al. | |
| 2,674,208 | A | 4/1954 | Keller et al. | |
| 2,985,118 | A | 5/1961 | Maharick et al. | |
| 2,997,967 | A | 8/1961 | Malapert | |
| 3,075,807 | A | 1/1963 | Werner | |
| 3,429,083 | A | 2/1969 | Voros | |
| 3,520,257 | A | 7/1970 | James | |
| 3,526,194 | A | 9/1970 | Schneider et al. | |
| 3,540,771 | A | 11/1970 | Stoneburner | |
| 4,842,323 | A | 6/1989 | Trickett | |
| 5,125,713 | A * | 6/1992 | Willingham | B60P 7/04 160/242 |
| 5,167,341 | A | 12/1992 | Morton et al. | |
| 5,181,474 | A | 1/1993 | Miller | |
| 6,848,734 | B1 | 2/2005 | Mulvaney | |
| 2009/0235841 | A1 | 9/2009 | Baranowski et al. | |
| 2010/0037798 | A1 | 2/2010 | Schaefer et al. | |

* cited by examiner

*Primary Examiner* — Zachary Kuhfuss
(74) *Attorney, Agent, or Firm* — Marsh Fischmann & Breyfogle LLP

(57) ABSTRACT

A cover assembly for covering an open-top, railroad freight car is presented that may include opposing sideboards projecting above the top edges of the rail car and a cover moveable between an open position and a closed position. In the open position, a containment volume may be accessible from above for the loading of a bulk commodity into the containment volume. In the closed position, the cover may substantially cover at least a majority of the containment volume from above. The cover may be elevated above a top edge of the rail car.

14 Claims, 19 Drawing Sheets

RAIL CAR COVER SYSTEM

CROSS-REFERENCE TO RELATED APPLICATIONS

This application claims priority as a continuation application to U.S. patent application Ser. No. 12/755,925, filed on Apr. 7, 2010, entitled "RAIL CAR COVER SYSTEM," which claims priority as a continuation application to U.S. patent application Ser. No. 12/632,649, filed on Dec. 7, 2009, entitled "RAIL CAR COVER SYSTEM," which claims priority to U.S. Patent Provisional Application Ser. No. 61/249,561 filed Oct. 7, 2009, entitled "RAIL CAR COVER SYSTEM." Each and every portion of each of the foregoing applications is hereby incorporated by reference in its entirety.

FIELD OF THE INVENTION

The invention relates to covering open-top, railroad freight cars, and a cover system that allows for movement of a cover to an open position and a closed position with respect to the rail car in order to cover and uncover containment volume of an open-top freight car.

BACKGROUND

Railroad transport, involving a string of attached railroad cars moving along a track, is used to transport passengers and a variety of cargos throughout the world. Railroad cars designed for carrying cargo are generally referred to as freight cars. Different freight car designs have been developed to more effectively meet the specific needs of different types of cargo. Examples of some different types of freight cars include boxcars, flatbed cars, tank cars, hopper cars and gondola cars. Freight trains may include many freight cars connected together, end-to-end in a long line. A freight train may be dedicated to a single typical cargo, in which case all or most of freight cars may be of a similar design, or a single freight train may haul a variety of different types of cargos, in which case it may be comprised of many different freight car designs to accommodate the different types of cargo.

Coal and other mineral commodities are often transported in dedicated freight trains, and especially when being transported from a mine. Such mined commodities are examples of bulk materials, or bulk commodities, and more particularly dry bulk commodities or dry bulk materials, which are typically loaded into freight cars in bulk form. Some examples of bulk materials include grains, ores, minerals, coal, food products, building materials, or any other material suitable for transport in a bulk fashion.

Many bulk commodities of a particulate nature, such as coal, mineral products and grains are often transported in top-loading freight cars, examples of which are gondola cars and hopper cars. For many bulk commodities, including coal, the freight cars are generally open at the top for most or all of the entire length of the freight car, which permits convenient loading of the entire freight-containment volume of the freight car from above while the freight car is moving. Transport in such open-top freight cars is efficient and convenient, and a significant infrastructure has been developed to handle loading and unloading of the large volume of bulk materials transported in such open-top freight cars.

Loading of bulk commodities into an open-top freight car is often accomplished by discharging the bulk material into the freight-containment volume from above via a loading chute positioned above or within the freight-containment volume of the freight car. Loading often occurs while the freight car is moving (rolling along the tracks in relation to the chute, so that bulk material is loaded along the entire length of the freight car). Unloading an open-top freight car is often accomplished either by a "bottom dump" or a "rotary dump" operation, depending upon the design of the freight car. In a bottom dump unloading operation, the bulk material is discharged from the bottom of the freight car, such as through chutes or doors located at the bottom of the freight-containment volume of the freight car. This may be the case, for example, for an open-top hopper car. In a rotary dump unloading operation, the entire freight car is rotated to the side until the bulk material spills out of the freight-containment volume. During the operation, the freight car is held in place on a rotating platform or other rotating structure, such as through the use of retaining clamps that are clamped pressed to the walls of the freight car. A structure surrounding the clamp and freight car is provided in order to pivotally rotate the rail car about a longitudinal access such that the freight car is transferred from an upright position to one where the freight car is on its side, or even upside down, such that the bulk material flows, or spills, out of the open top of the freight car. The freight cars may be connected together with rotary couplings to permit the rotation of one of the freight cars at a time or a few of the freight cars as a unit.

As will be appreciated, loading and unloading infrastructure is based on there being a level of uniformity in design among open-top freight cars.

SUMMARY OF INVENTION

Covering of open-top railroad freight cars during transport of bulk commodities may provide the advantages of better control of dust by protecting the load from external moving air and better fuel efficiency by reducing drag associated with the geometries of the load and internal surfaces of the freight car. The invention concerns covering top-loading freight cars with a cover that may be manipulated to cover and uncover a freight-containment volume of the top-loading freight cars. The cover is well-suited for top-loading freight cars for which open-top access from above to most or substantially all of the freight-containment volume is desirable. The cover is adaptable for use with existing infrastructure for loading and unloading top-loading freight cars used for the transport of bulk commodities, and especially those bulk materials of a particulate nature such as coal and other mineral products.

In one aspect, the invention provides a top-loading railroad freight car for bulk commodity haulage. At least a majority, and preferably all of a freight-containment volume within a containment structure of the freight car may be covered and uncovered by a cover that is moveable between an open position and a closed position. Movement of the cover between the open and closed positions is guided by tracks on opposing sideboards attached to sidewalls of the containment structure. The sidewalls project at least 0.1 meter, or more, higher than the sidewalls. When the cover is in the closed position, the cover is supported by the sideboards above the freight-containment volume with at least a portion, and preferably at least a large portion, of the cover at a vertical elevation of at least 0.1 meter, or more, higher than top edges of the sidewalls. With one enhancement, the cover may extend from substantially one longitudinal end to the other longitudinal end of the containment volume. With another enhancement, when the cover is in the open position, most or substantially all of the cover may retract into a roll. Railroad freight cars tend to be relatively long and narrow. With one enhancement, the cover, when in the closed position, may be at the higher vertical elevation over the portion of the length dimension of the containment volume that is not within 3 meters, or even less, from either longitudinal end of the containment volume, and with a further enhancement, when the cover is in the open position, access from above to the containment volume is free of obstructions at least along that portion of the length dimension, which facilitates top-loading of the freight car from above while the freight car is rolling.

In another aspect, the invention provides a railroad car cover assembly for a top-loading railroad freight car for bulk commodity haulage, and which may be in the form of a retrofit cover assembly for retrofitting a retractable cover to a top-loading railroad freight car.

In another aspect, the invention provides a sideboard adapted for attachment to a sidewall of a top-loading railroad freight car for bulk commodity haulage. The sideboard has a track to engage with and guide translation of a cover between open and closed positions to cover and uncover a containment volume of such a top-loading rail car.

DETAILED DESCRIPTION OF THE DRAWINGS

Figure 1:
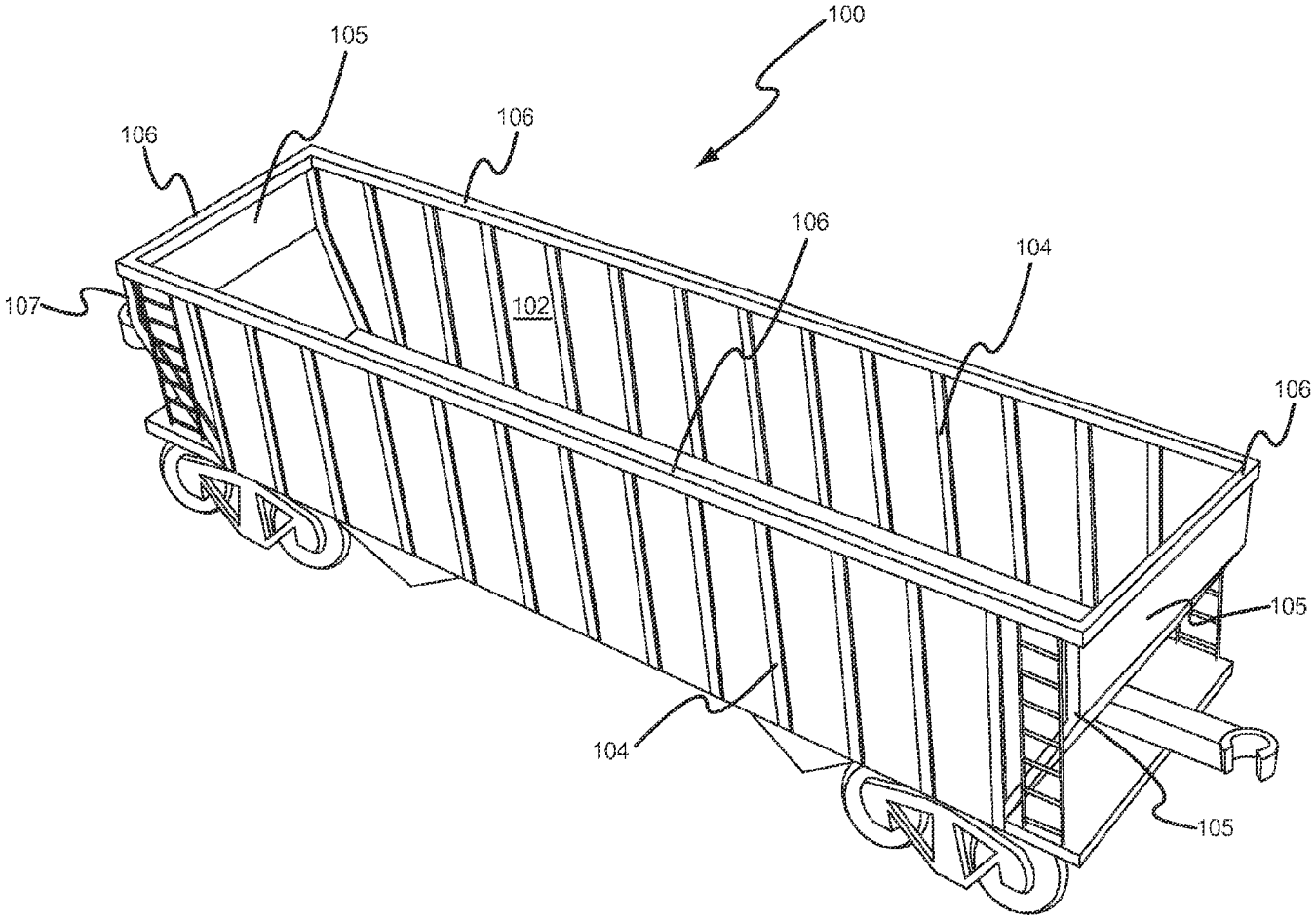
FIG. 1 is a perspective view of a rail car.

FIG. 1 shows an example of one design for an open-top railroad freight car 100. The freight car 100 has a containment structure that defines an interior containment volume 102 in which a bulk commodity may be disposed for transport via the freight car 100. The containment structure includes the bottom of the freight car on which bulk commodity is supported and vertically extending sidewalls 104 that laterally contain the bulk commodity and substantially define the containment volume 102 in the example of FIG. 1. The containment structure includes opposing sidewalls 104 extending along the length of the freight car 100 and opposing endwalls 105 extending across the width of the freight car 100. The sidewalls 104 and endwalls 105 terminate at top edges 106 of the top of the containment volume 102. The top edges 106 may be at a constant elevation at all points along the top edges 106. The containment volume 102 is open at the top along the top edge 106. As such, the containment volume 102 is exposed from the top, such that material may be loaded into the containment volume 102 from above for containment therein by the containment structure of the freight car 100. By a vertically projecting wall, it is meant that the wall has a vertical aspect in that the top edge of the wall is at a vertical elevation that is higher than the base of the wall. For example a wall, or a portion thereof, may project upward at an angle. In one example of the freight car 100 shown in FIG. 1, the endwalls 105 each have a slanted portion 107 in addition to vertical portions.

Figure 2:
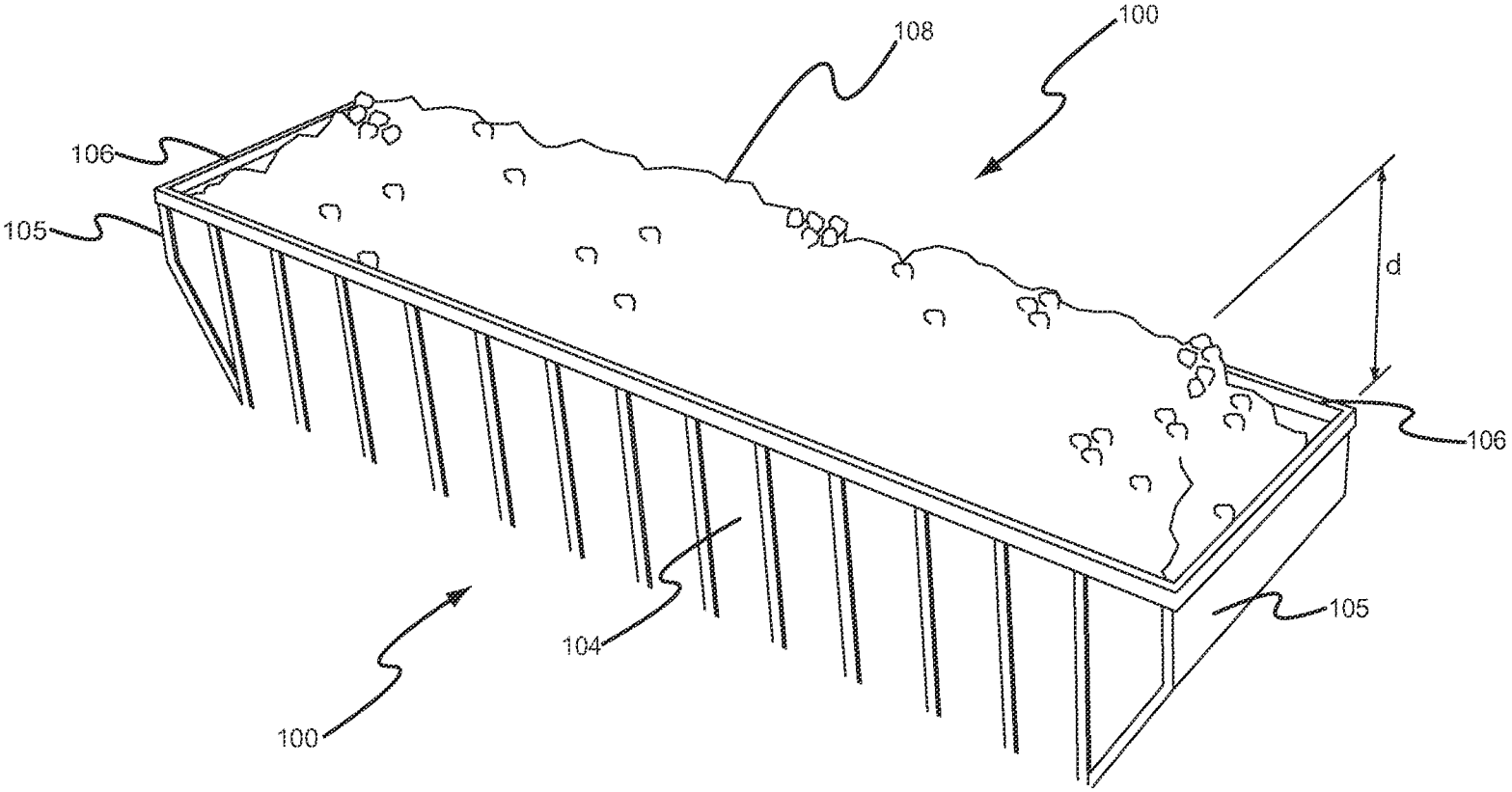
FIG. 2 is a perspective view of a rail car.

FIG. 2 shows a top portion of the same railroad freight car 100 loaded with a bulk material 108. Such bulk material may be, for example, coal, ore, grains or mineral materials. The sidewalls 104 and endwalls 105 provide lateral support to the bulk material 108. As shown in FIG. 2, the bulk material 108 projects above the containment volume to a vertical elevation that is a distance 'd' higher than the top edges 106. This may be a result of heaping or mounding of the bulk material 108 during loading operations to load the freight car 100. It should be appreciated that although the top of the containment volume 102 of the freight car 100 is defined by the top edges 106, bulk material may be loaded into the freight car 100 so that a portion of the load projects above the top of the containment volume, such as in a heap or mound. For example, when transporting coal in the United States, it is common for coal to be mounded above the top edges of the containment structure by up to about 0.66 m.

The particular freight car shown in FIGS. 1 and 2, and the other FIGS., is only one example of an open-top freight car that may be used with or incorporated as part of an aspect of the invention. For example, the open top freight car for use with the invention may have a containment structure with walls of different configurations than shown in FIGS. 1 and 2, for example four walls that are substantially vertical and do not have a slanted portion, or containing a one or more slanted walls or walls having a slanted portion. Although it is often preferred that top edges of the freight car are substantially even at the same elevation, such is not required, and top edges of different walls may be of different heights, and the top edges may have any topographic configuration and need not be of uniform between different wall or even over all of a single wall.

Figure 3:
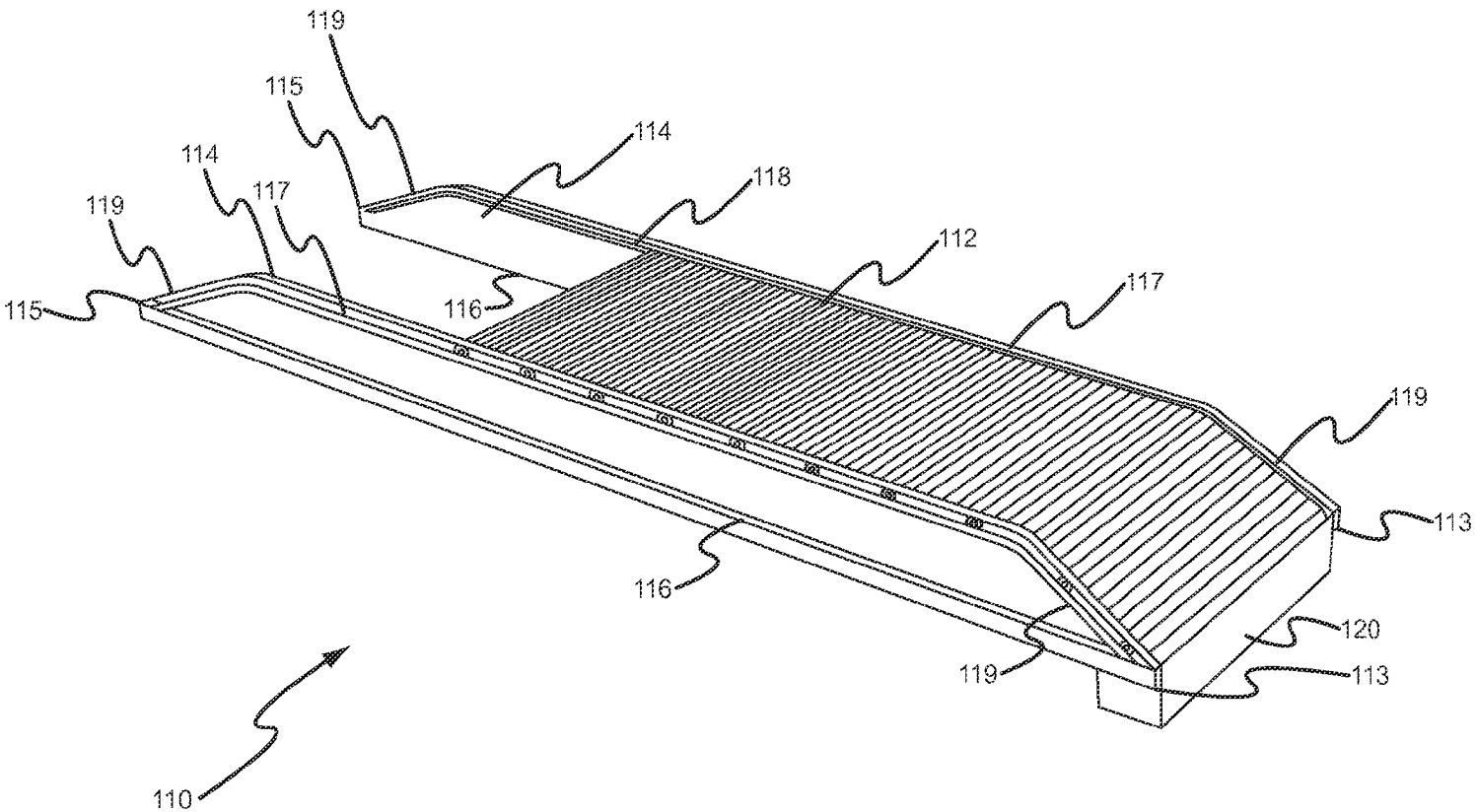
FIG. 3 is a perspective view of a cover assembly.

FIG. 3 shows one embodiment of a cover assembly 110, such as may be used to cover all or a portion of a containment volume of an open-top freight car. As shown in FIG. 3, the cover assembly 110 has opposing sideboards 114. The sideboards 114 may each have a bottom side 116 and a top side 117. The sideboards extend lengthwise from a first longitudinal end 113 to a second longitudinal end 115. In one embodiment, the bottom side 116 may be adapted to be disposed toward and to be attached to corresponding walls of a top-loading freight car. Such attachment may be by any means of attachment, including, for example by, bolts, pins, clamps, welding, rivets, or through an intermediate structure or structures that may be disposed intermediate between a sideboard 106 and a corresponding wall. Each sideboard 114 includes a track 118 extending lengthwise for at least some distance along the sideboard 114 adjacent to the top side 117. In one implementation, the track 118 may extend substantially all the way from the first longitudinal end 113 to the second longitudinal end 115. In the variation shown in FIG. 3, the sideboard 114 has ramped portions 119 adjacent the first and second longitudinal ends 113, 115, and the track 118 extends substantially entirely between the first and second longitudinal ends. The sideboards 114 are arranged in opposing fashion so that the tracks 118 correspond and are designed to guide the translation of a cover 112. The cover 112 may engage the tracks 118 of both sideboards 114 such that the tracks 118 of the sideboards 114 define a path along which the cover 112 may be moved. Engagement of the track may be through a corresponding engagement structure on the cover 112. An engagement structure may, for example, be adapted to slide in tracks 118 to facilitate movement. In another variation, an engagement structure of the cover 112 may have wheels that roll along the tracks 118. The cover 112 is moveable as guided by the tracks 118 to various positions along the length of the sideboards 114 and the tracks 118. The cover 112 may be advanced and retracted to various positions along the track from the first longitudinal end 113 toward the second longitudinal end 115 of the sideboards 114. When the cover 112 is retracted toward the first longitudinal end 113, the cover 112 is received into a receptacle 120. When the cover 112 is advanced, the cover 112 exits from the receptacle 120. In one preferred implementation, the cover may be fully retractable so that most, or substantially all, of the cover 112 is received in the receptacle 120 so that the space between the sideboards 114 is uncovered substantially from the first longitudinal end 113 to the second longitudinal end 115. In one preferred implementation, the cover may be fully advanceable substantially to the second longitudinal end 115 to provide for full covering between the sideboards 114 substantially from the first to second longitudinal ends 113, 115. The cover 112 may also be moved to any intermediate degree of advancement between the fully advanced and fully retracted positions.

Figure 4:
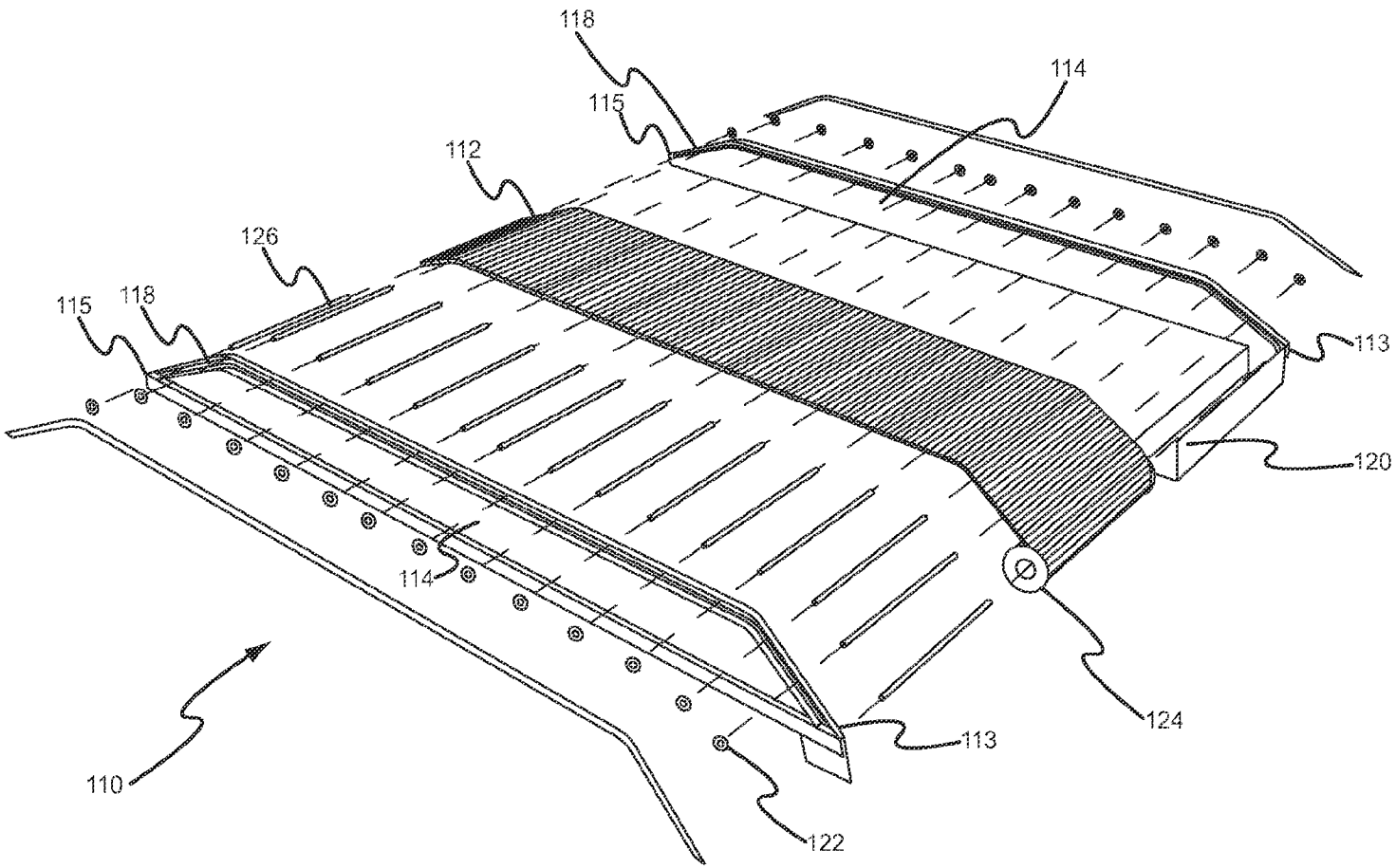
FIG. 4 is a perspective view of an exploded cover assembly.

FIG. 4 shows an exploded view of a variation of the cover assembly 110. As shown in FIG. 4, the cover 112 may have members 126 (e.g., rods, bars, etc.) extending laterally through the cover 112 and generally in a direction between the sideboards 114. Such members 126 may extend partially or fully through the cover 112 and may provide structural support to the cover 112. In the variation shown in FIG. 4, the members 126 engage wheels 122 that may engage with the tracks 118 of the sideboards. The wheels 122 may rotate about the corresponding members 126 within the track 118 to assist smooth movement of the cover 112 along the track 118. The cover 112, including the members 126 and wheels 122, may retract into a roll 124 within the receptacle 120. The receptacle 120 accommodates the roll 124 comprising a rolled portion of the cover 112 when the cover 112 is in a retracted or partially retracted position. The roll 124 may include a spool around which the cover 112 may be disposed. The spool may be driven by any appropriate driver to produce movement of the cover 112 to advance or retract the cover along the track 118 and to unroll and roll, respectively, the cover 112 from and into the roll 124.

Figure 5:
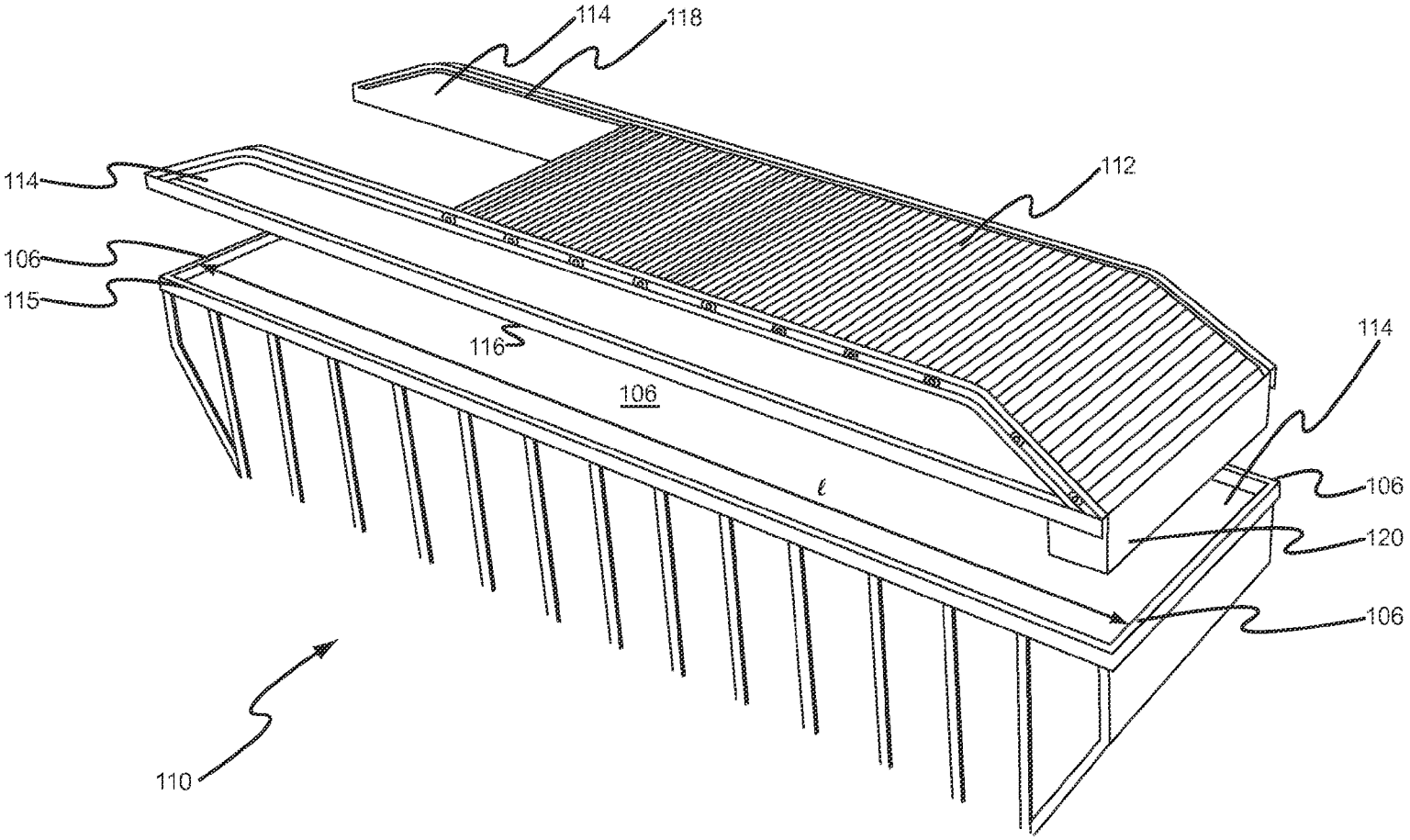
FIG. 5 is a partially exploded perspective view of a rail car and cover assembly.

The cover assembly 110 may be adapted to be mounted on opposing walls of an open-top railroad freight car. For example, FIG. 5 shows the cover assembly 110 positioned for mounting on the freight car 100 described previously with reference to FIGS. 1 and 2. As shown in FIG. 5, the sideboards 114 of the cover assembly 110 are configured to correspond with and to be mounted on the sidewalls 114 of the freight car 100. The cover assembly 110 may be provided as a retrofit assembly that may be retrofitted to existing open-top rail cars. The receptacle 120 may be disposed fully or partially inside the containment volume 102 when the cover assembly 110 is mounted on the freight car 100, or may be disposed partially or wholly outside the containment volume 102.

Figure 6:
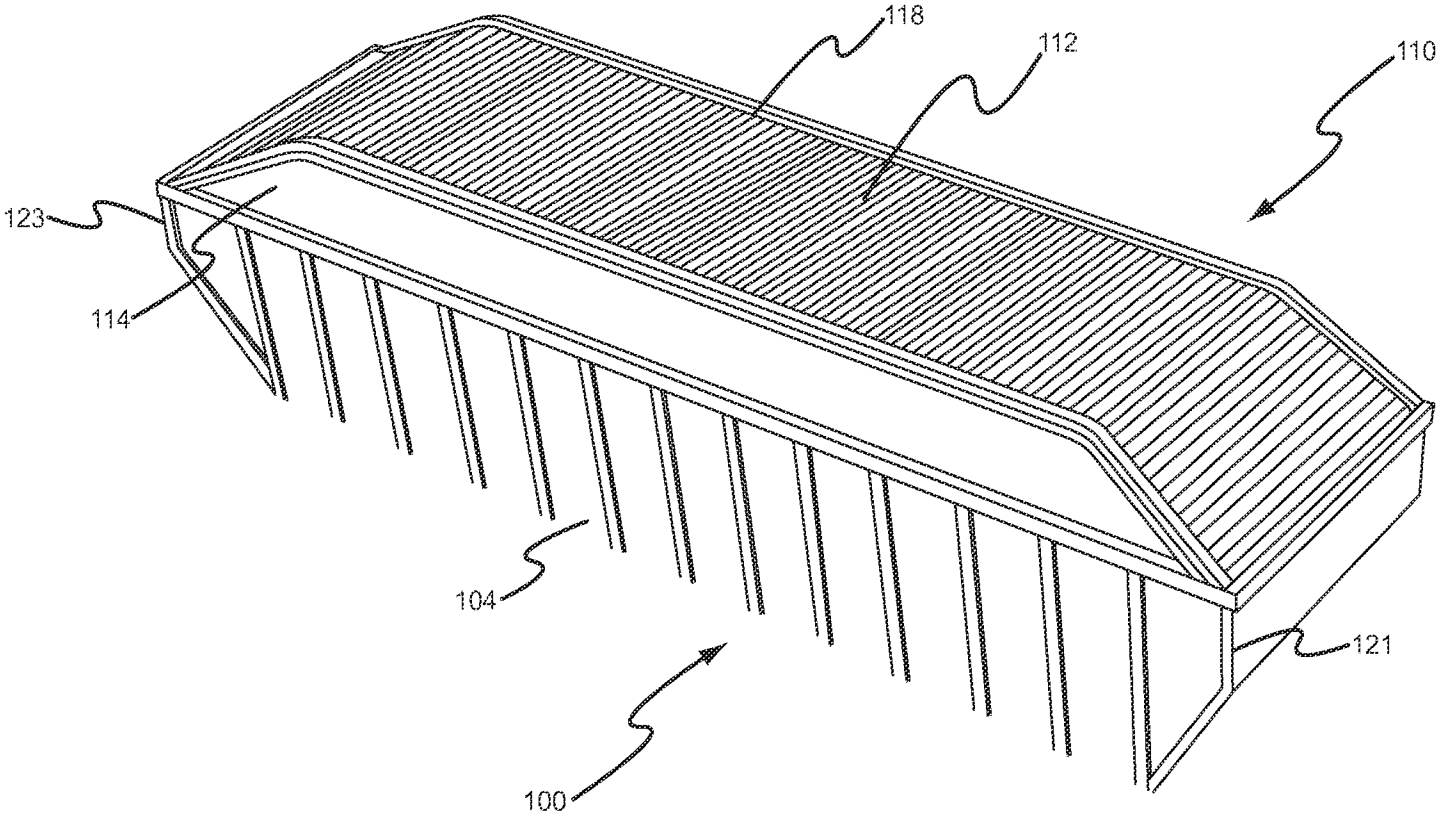
FIG. 6 is a perspective view of a rail car with a cover assembly.

FIG. 6 shows the cover assembly 110 mounted on the freight car 100. In the variation of FIG. 6, the sideboards 114 extend over substantially the entire length of the sidewalls 104 from a first longitudinal end 121 to a second longitudinal end 123 of the sidewalls 114. FIG. 6 shows the cover 112 in a closed position. In the configuration of FIG. 6, when in the closed position the cover 112 extends substantially entirely from the first longitudinal end 121 to the second longitudinal end 123 of the sidewalls 114, and the cover 112 extends substantially over the length of the freight car 100 from one end of the freight car 100 to the other end of the freight car to cover substantially all of the containment volume 102. Movement of the cover 112 is guided by the tracks 118 of the sideboards 114, and in this configuration, the tracks 118 extend over substantially the entire length of the sidewall 104 of the rail car 100. As shown in FIG. 6, the containment volume 102 is substantially covered, so that a load of bulk commodity may be protected from the exterior environment during transportation. Retraction of the cover to an open position permits access to substantially all of the containment volume 102, such as for loading and/or unloading operations. In this regard, the advantages of dust control and fuel efficiency may be facilitated.

Figure 7:
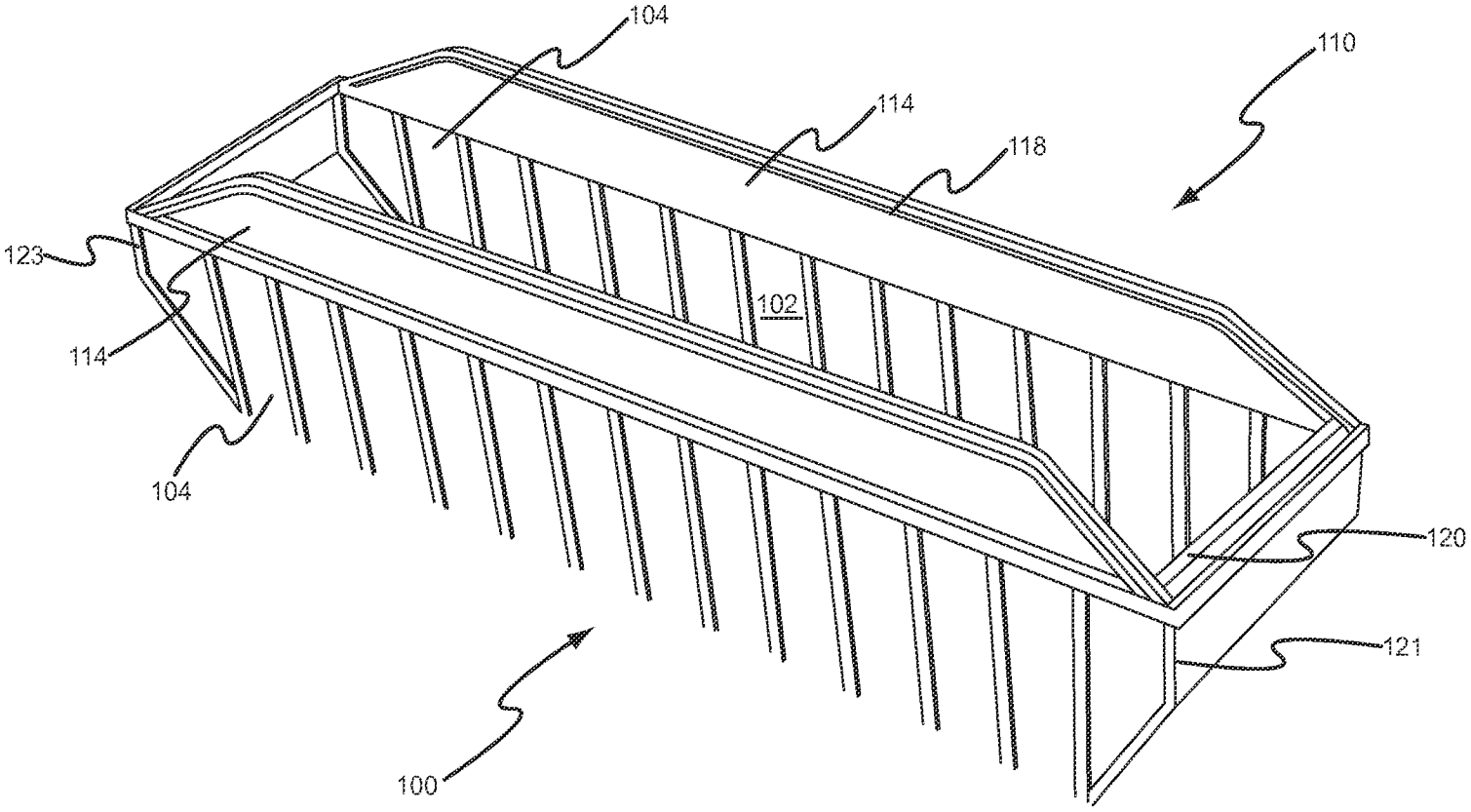
FIG. 7 is a perspective view of a rail car cover in an open position.

In FIG. 7, the cover assembly 110 is shown mounted onto the freight car 100 with the cover 112 fully retracted in an open position, in which the containment volume 102 is open at the top without obstructions that would obstruct access into the open top of the containment volume 102 substantially over the entire length of the containment volume 102 from the receptacle 120 to the opposite end of the freight car 100 in the longitudinal direction of the freight car 100. Also, the sidewalls 114 do not project over the containment volume 102, or if they do project over the containment volume 102, the projection is of an extent not to be incompatible with loading or unloading operations. As will be appreciated, the configuration shown in FIG. 7 allows for substantial access to a majority of and preferably substantially all of the containment volume 102 when the cover 112 is in the open position. In this regard, for example, loading operations conducted on the freight car 100 (e.g., to load a bulk material into the containment volume 102) may be conducted without substantial obstruction by the cover 112 or other portions of the cover assembly 110.

Figure 8:
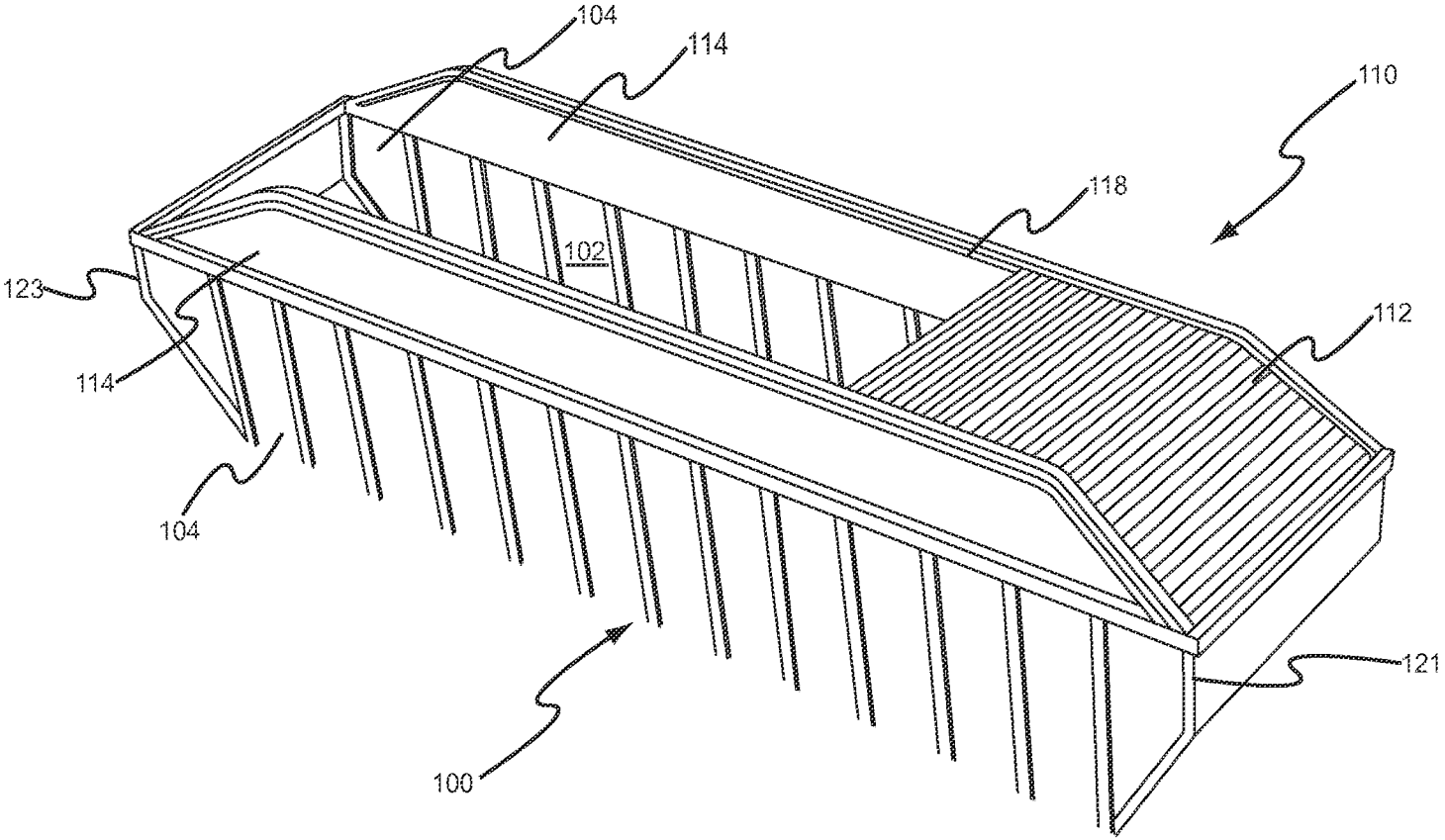
FIG. 8 is a perspective view of a rail car cover between an open and a close position.

FIG. 8 shows the cover 112 at a position intermediate between the open and closed positions. In this regard, a portion of the containment volume 102 is exposed from above, while a portion is covered and not exposed from above. As will be appreciated, as the cover 112 is moved between an open position such as shown in FIG. 7 and a closed position such as shown in FIG. 6, the cover 112 will pass through a range of such intermediate positions. Motion of the cover 112 may be produced by various means. For example such means may include a pulley system, pneumatic drive, an electric motor, or other means. When full access to the containment volume 102 is not required, the cover assembly 110 permits limited access to the containment volume 102, and to bulk material that may be loaded into the freight car 100, without requiring that the cover 112 be fully opened to the open position. For example, the cover 112 may be opened to an intermediate position to permit access to check a load of bulk material or to perform some operation not requiring full access to the containment volume of the load.

Figure 9:
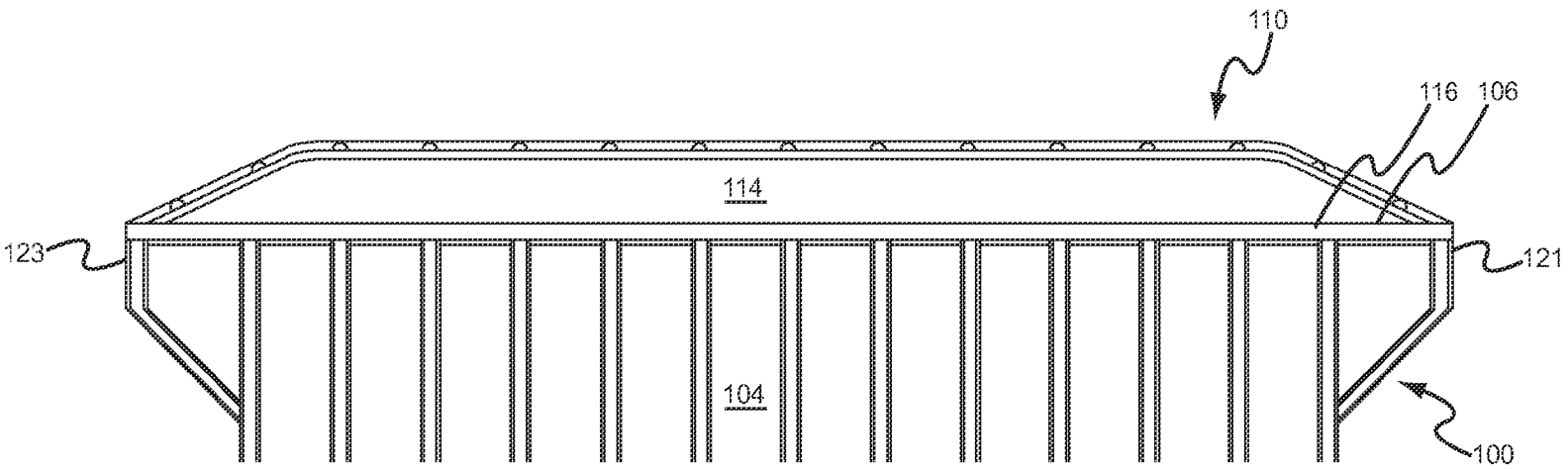
FIG. 9 is a side view of a rail car with a cover assembly affixed thereto.

FIG. 9 shows a partial side elevation of the freight car 100 with the cover assembly 110 mounted thereon. In the configuration of FIG. 9, the cover is shown such that the bottom sides 116 of the sideboards 114 may be disposed adjacent to and attached to the sidewalls 104 at or adjacent to the top edges 106 of the sidewalls 104 of the rail car 100. It will be further appreciated in FIG. 9 that the sideboards 114 project to an elevation that is higher than the top edge 106 of the sidewall 104. The sideboard 114 may advantageously project to an elevation above the top edge 106 to accommodate a bulk material mounded or heaped above the top edge 106 of the sidewall 104. In one variation, the sideboard 114 may project to an elevation that is at least 0.1 meter higher than the top edges 106 of the sidewalls 104. In other variations, the sidewalls 114 may project to an elevation that is higher than the top of a sidewall 104 by at least an amount selected from the group consisting of 0.1 meter, 0.2 meter, 0.3 meter, 0.5 meter, 0.6 meter, 0.7 meter and 1 meter. A sideboard 114 may be elevated by such a minimum specified amount higher than a top edge 106 of a sidewall 104 along a substantial portion of the length of the sideboard 114. Additionally, the track 118, and also the cover 112, when in the closed position, may be at an elevation that is higher than the top edge 106 of a corresponding sideboard by at least an amount selected from the group consisting of 0.1 meter, 0.2 meter, 0.3 meter, 0.5 meter, 0.6 meter, 0.7 meter and 1 meter.

In one implementation, when the cover 112 is in the closed position, the cover 112 may be at the noted higher elevation relative to the edges 106 of the sidewall 104 along a substantial portion of the length of the containment volume 102 of the freight car 100. In one variation, the containment volume has a length dimension of at least 14 meters between longitudinal ends of the containment volume 102. When in the closed position the cover 112 may be at the noted higher elevation relative to the top edges 106 of the sidewalls 104 at least along substantially all of the length dimension that is not within 4 meters, preferably not within 3 meters, more preferably not within 2 meters or even and not within 1.5 meters of either longitudinal end of the containment volume 102. As shown in FIG. 5, the length dimension of the containment volume 102 of the freight car 100 between longitudinal ends of the containment volume 102 is indicated by the dimension "l".

Figure 10:
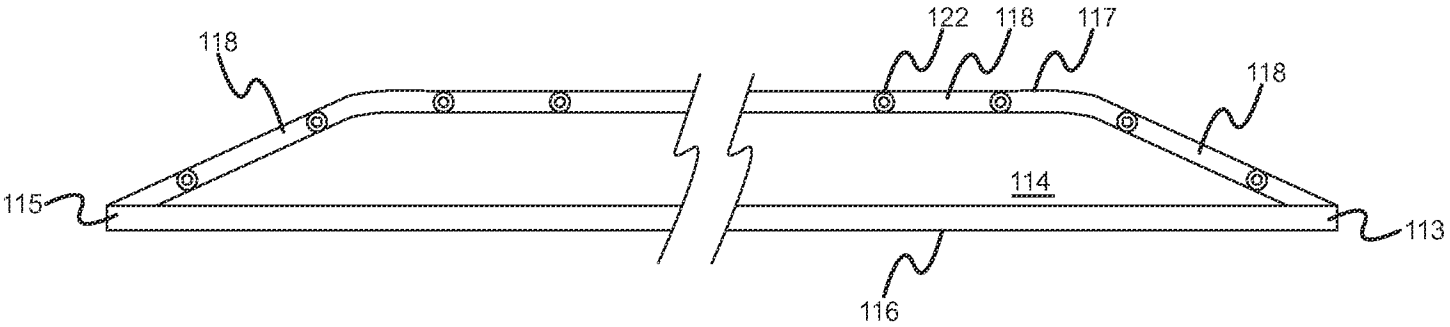
FIG. 10 is a side view of a sideboard for a cover assembly.

FIG. 10 shows one variation of the sideboard 114. Reference numerals are as before. The track 118 extends between the longitudinal ends 113, 115 of the sideboard 114. Although not a part of the sideboard, the wheels 122 are shown engaging the track 118 of the sideboard 114 as one example of an engagement structure for a cover 112. Engagement between a cover and track may be facilitated by material selection between the track and the cover, bearings, rollers, or any other means facilitating movement of pieces relative to each other. Additionally, in one variation, the edge portions of a cover material may directly engage a corresponding track such that the cover simply slides in the track.

Figure 11:
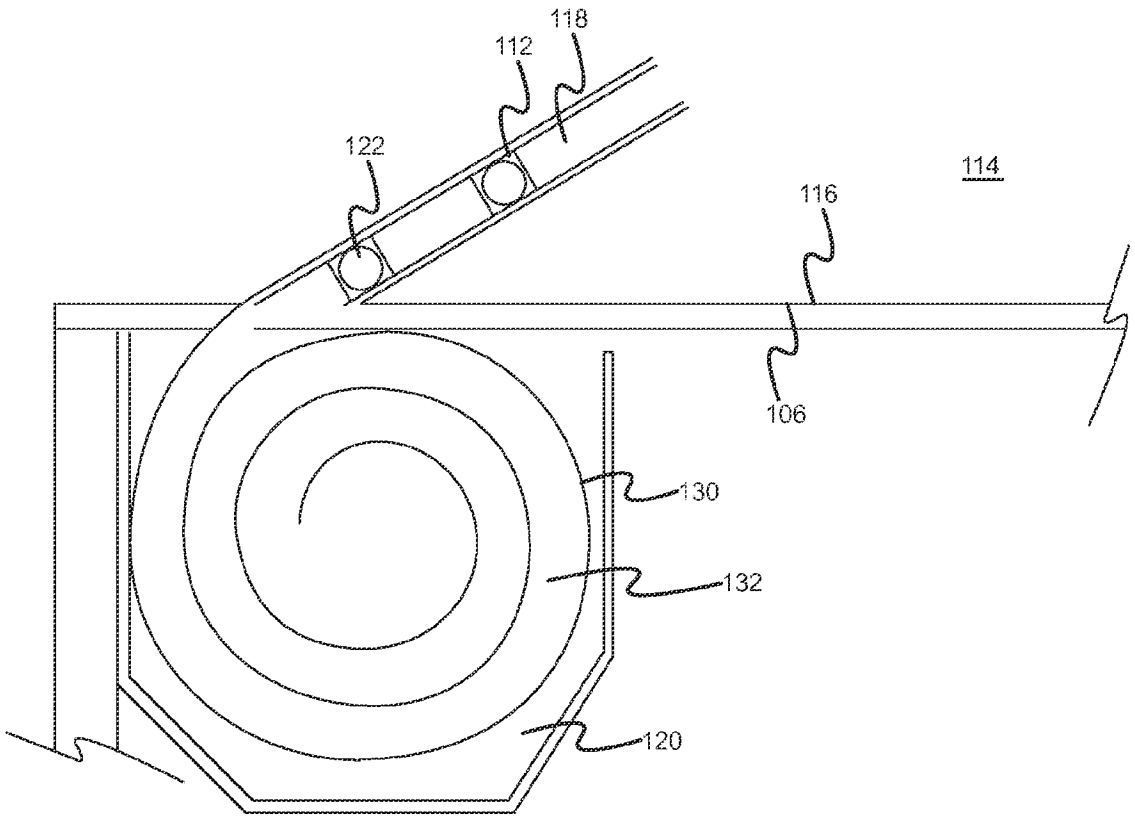
FIG. 11 is a detailed view of a roll container.

FIG. 11 shows in greater detail one example configuration for the track 118, cover 112 and receptacle 120. As shown in the configuration of FIG. 11, the cover 112 is engaged with the track 118 of the sideboard 114. The cover 112 is translatable in the track 118 between open and closed positions. When in the closed position, the cover 112 may be mostly or substantially entirely contained within the track 118. The cover 112 may align with and enter into a spiral channel 132 defined by a roll guide 130. As will be appreciated, as the cover 112 is retracted more of the cover 112 is disposed within the spiral channel 132. When the cover 112 is in the closed position most or substantially all of the cover 112 may be disposed within the spiral channel 132. Alternative configurations are possible for receiving the cover 112 in the receptacle 120. For example, a receptacle 120 may comprise a spool member capable of gathering and holding the cover 112 about the spool member.

Figure 12:
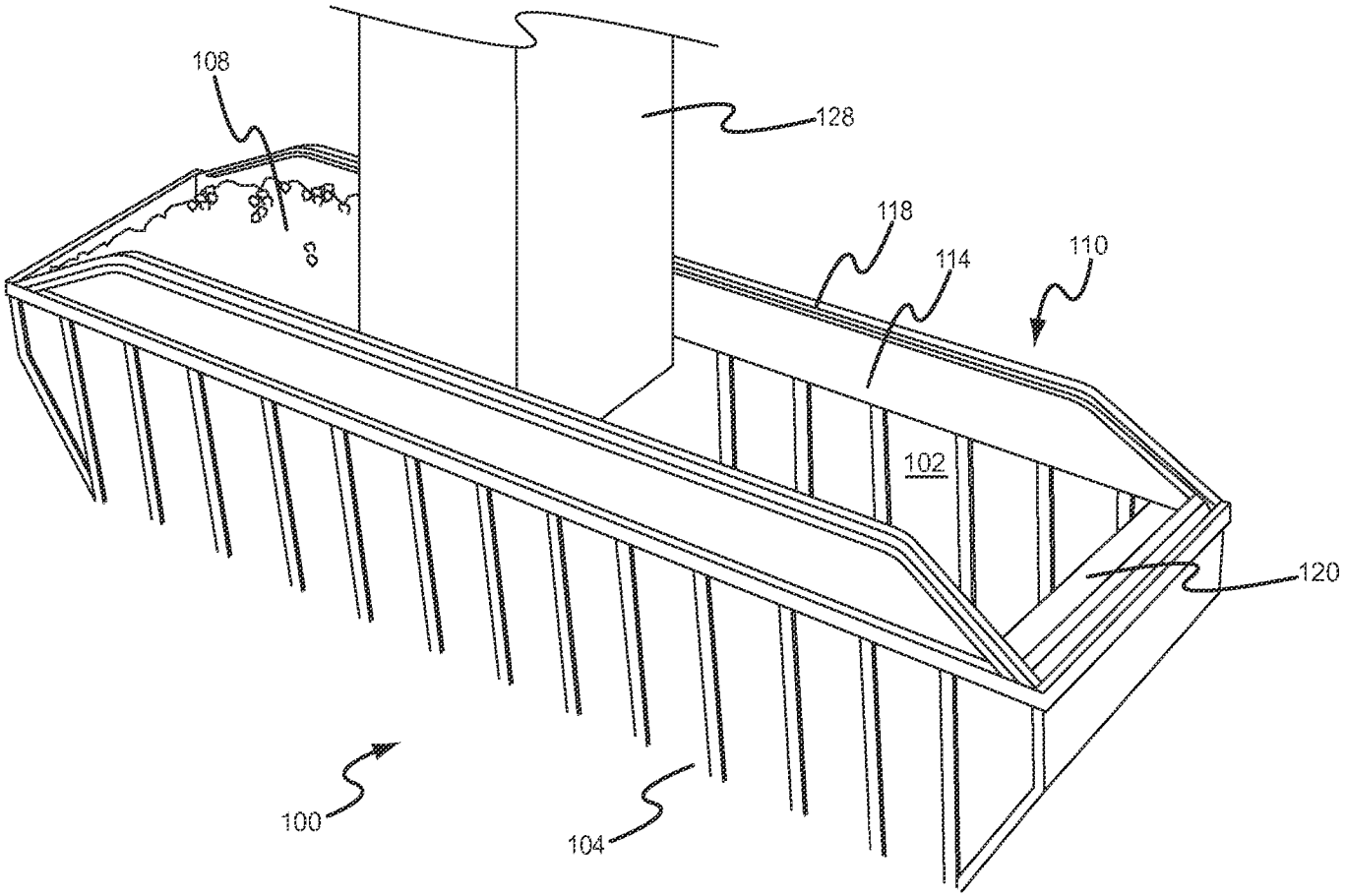
FIG. 12 is a perspective view showing a rail car with a rail car cover being loaded by a loading chute.

FIG. 12 shows a rail car 100 equipped with a cover assembly 110, and which is in the process of being loaded with a bulk material 108. During the loading process, a loading chute 128 may be lowered adjacent to or below the top edges 106 of the sidewalls 104 to facilitate the loading of the bulk material 108 into the containment volume 102. As will be appreciated, the loading chute 128 may occupy a portion of the width of the rail car 100 between the sideboards 114. The cover assembly 110 does not obstruct the loading chute 128 from loading bulk material into the containment volume 102. In this regard, the loading of the freight car 100 may be performed in the same general manner as for open-top rail cars not including a cover. The cover assembly 110 does not obstruct access to the containment volume 102 from above when the cover 110 is in the open position in the configuration as shown in FIG. 12. The bulk material 108 may be loaded into the freight car 100 to an elevation higher than the top edges 106 of the rail car 100 for a substantial portion of the length of the rail car. In this regard, the sideboards 114 may accommodate and provide for this portion of the bulk material 108 that may extend above the top edges 106 in that the sideboards 114 project above the top edges 106 of the sideboards.

Figure 13:
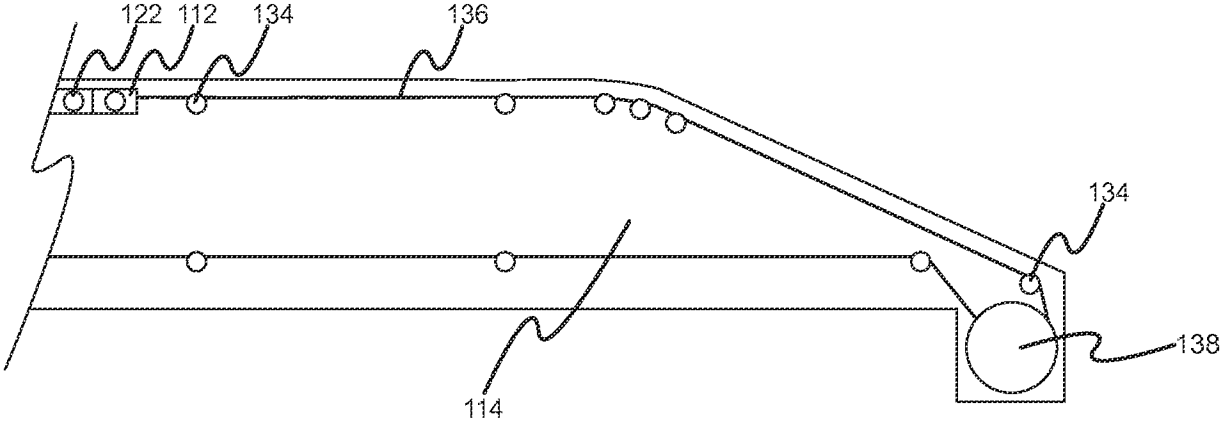
FIG. 13 is a schematic view of a sideboard assembly.

FIG. 13 shows another variation of a configuration for the sideboard 114 and cover 112. This configuration includes a drive mechanism including a cable 136 disposed at least partially within or adjacent to a track of the sideboard 114. The cable 136 may form a loop such that the cable 136 and the cover 112 move in unison. The cable 136 may be in driving engagement with a drive wheel 138 to cause movement of the cable 136 within the sideboard 114 The drive wheel 138, in one embodiment, may be located within the receptacle 120. The drive wheel 138 may be driven, for example, by an electric motor, a pneumatic source, a mechanical linkage, or any other means. The cable 136 may be guided by a series of pulleys 134 to guide and/or ease the movement of the cable 136 when driven by the drive wheel 138. The cable 136 may be fixed to the cover 112 such that movement of the cable 136 provides a corresponding movement of the cover 112. In this regard, when the drive wheel 138 is driven in a clockwise fashion as shown in FIG. 13, the cover 112 may be moved from left to right towards the closed position. Alternatively, anti-clockwise motion of the drive wheel 138 as shown in FIG. 13 may produce movement of the cover 112 from right to left such that it moves toward the open position. The drive mechanism may provide for either opening or closing of the cover 112 such that the opposite movement is produced by a biasing force, for instance by way of a spring, in order to produce the alternative motion. The cable may be of any material or materials, for example, of steel and/or of polymers.

Figure 14:
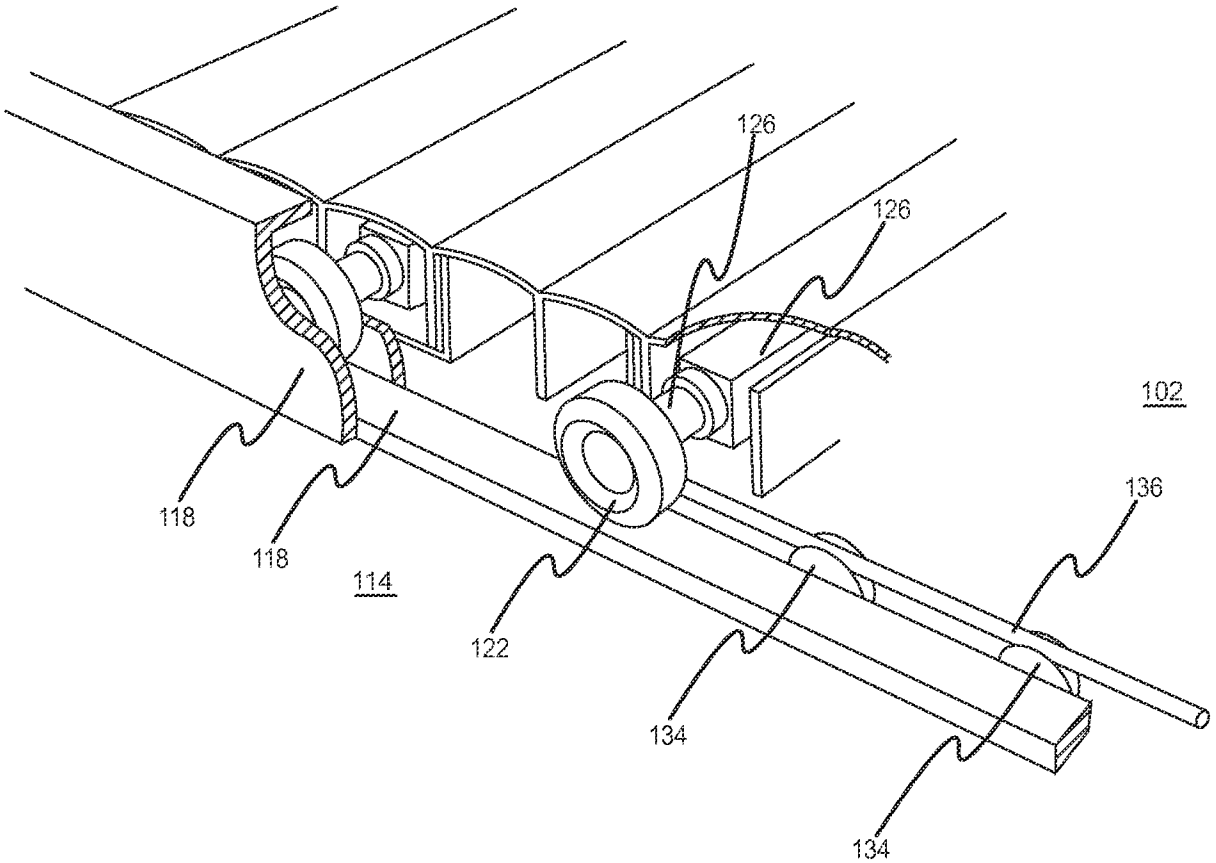
FIG. 14 is a detailed perspective view of a cover and a track.
Figure 15:
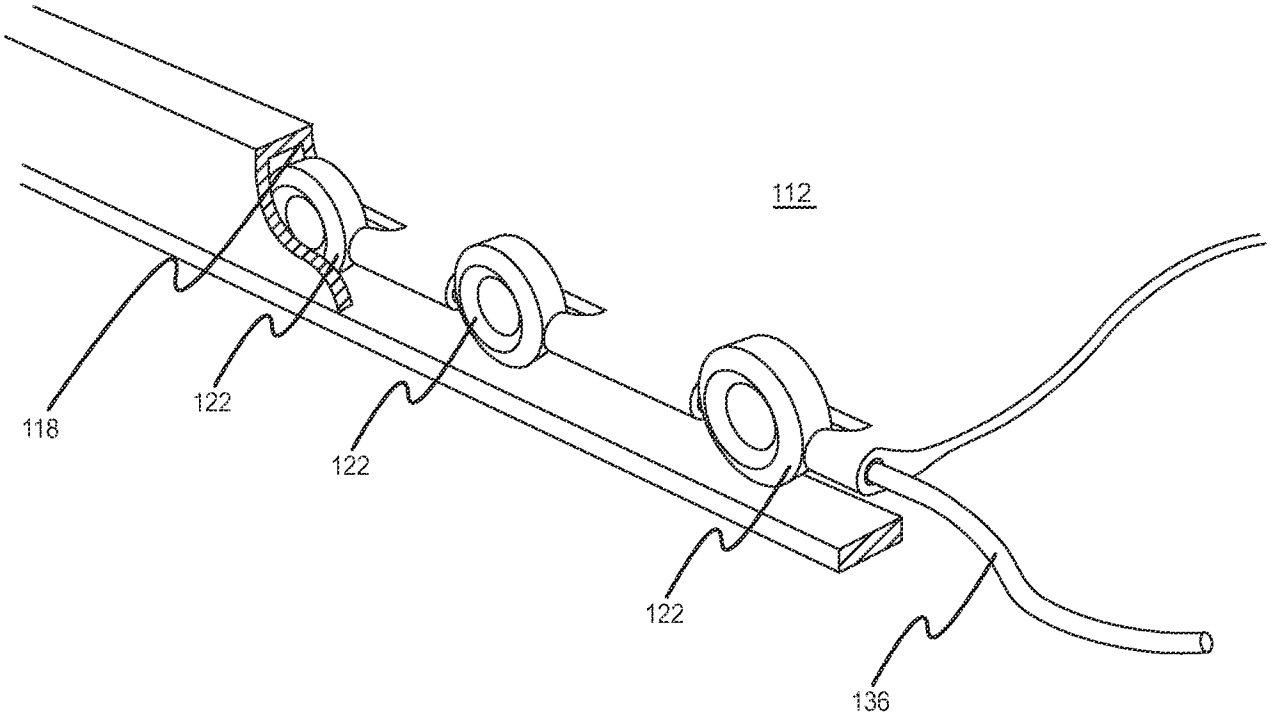
FIG. 15 is a perspective view of a cover and a track.

FIG. 14 shows detail of one variation for implementation for such a cable drive mechanism. In the variation shown in FIG. 14, the cover 112 includes the wheels 122 provided at the end of the members 126 running laterally through the cover 112. As such, the wheels 122 may cooperate with a track 118 to produce rolling engagement of the cover 112 with the track 118. The cable 136 may be disposed adjacent to or within the track 118 and guided by the pulleys 134. The cable 136 may be attached directly to the cover 112, or indirectly through intermediate structure, such that movement of the cable 136 produces a corresponding movement of the cover 112. It will be appreciated that in this regard, the cable 136 may be moved, for instance by way of a drive wheel 138, in order to move the cover 112 from the open position to the closed position. The cable 136 may be driven in either direction to produce the corresponding movement either from closed to open position or from open to closed position. FIG. 15 shows in detail of another implementation for such a cable drive mechanism, wherein the cover 112 comprises a soft or pliable material, such as for example a tarp.

Figure 16:
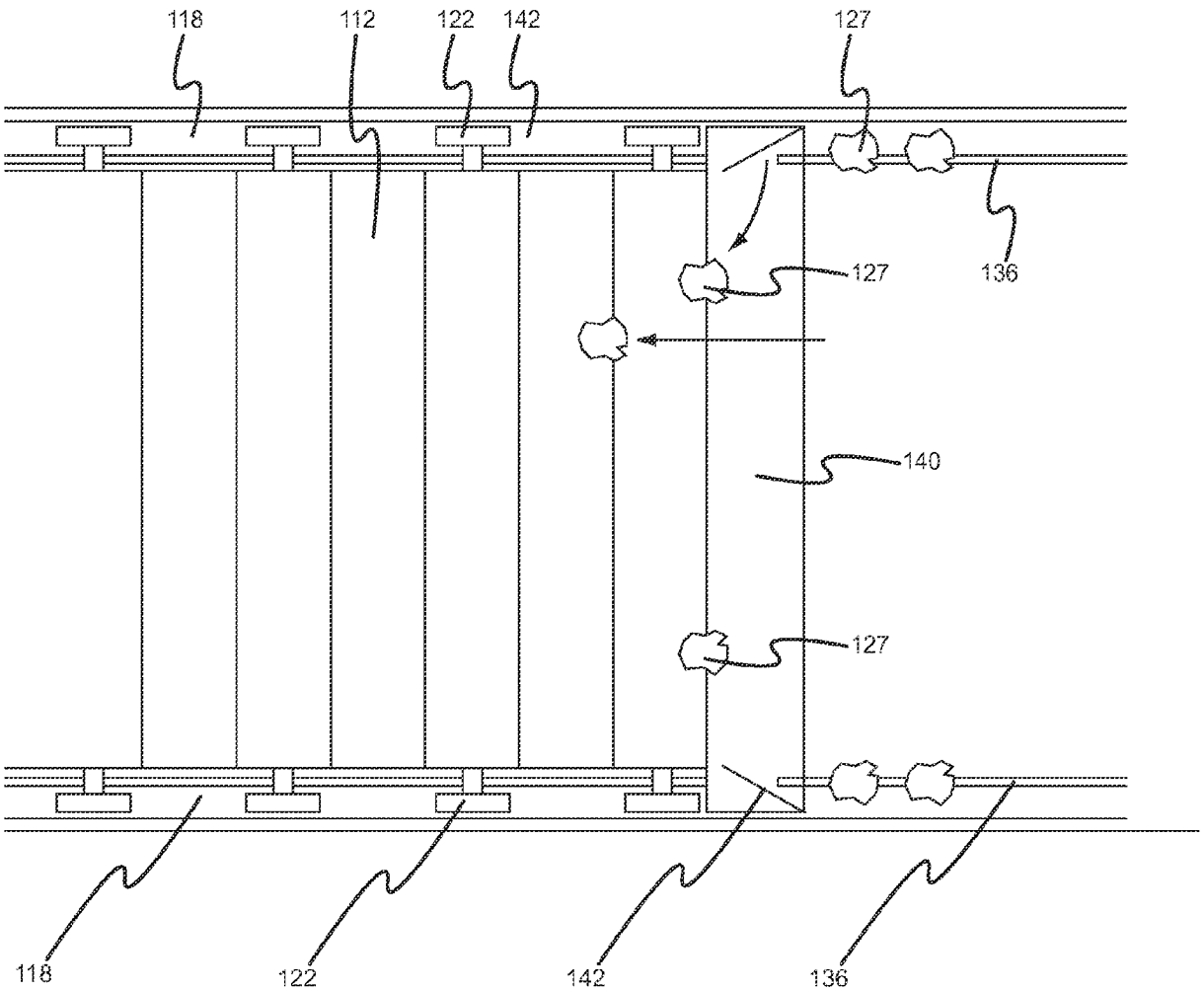
FIG. 16 is a top view of a cover with a plow.
Figure 17:
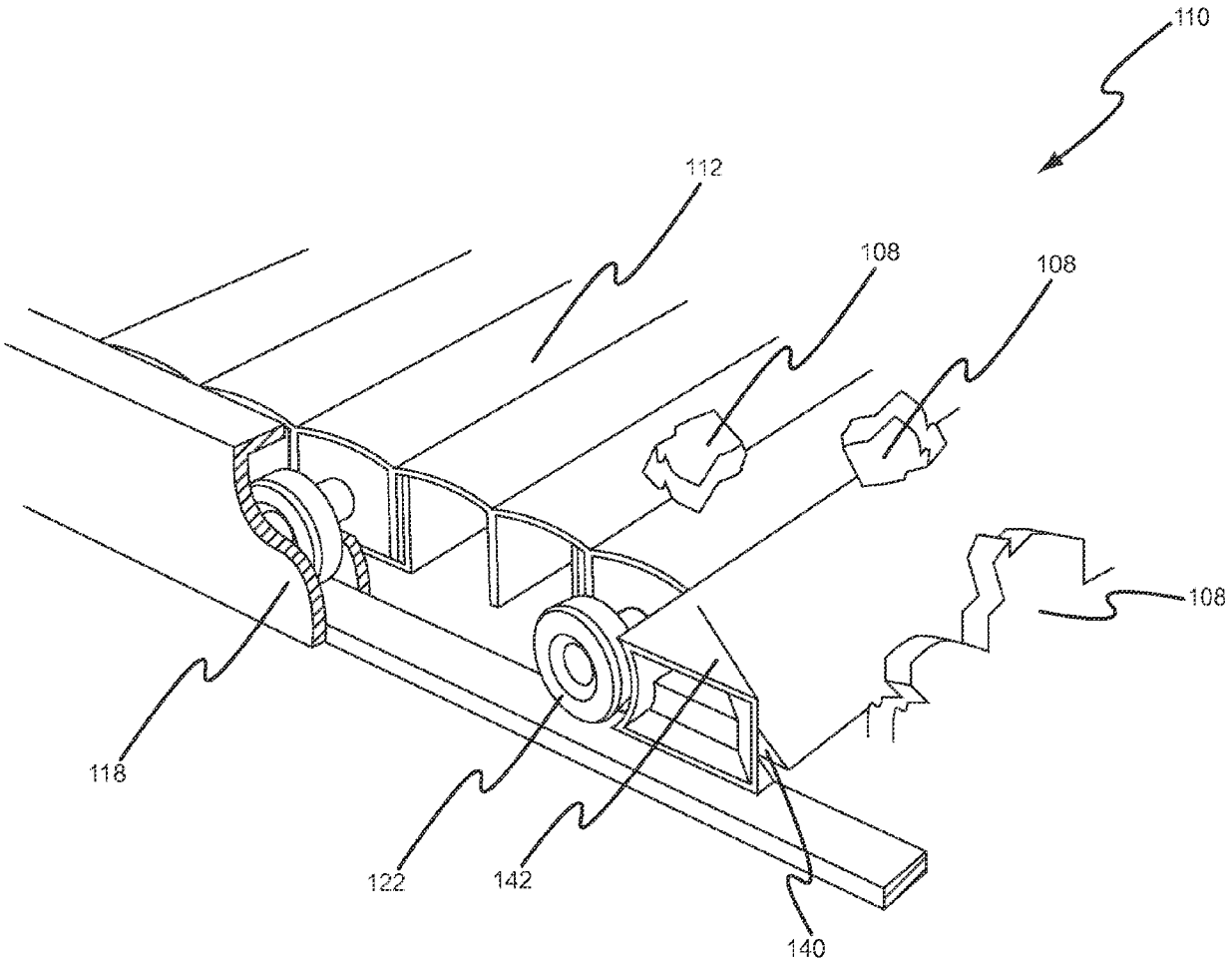
FIG. 17 is a detailed perspective view of a cover with a plow.

FIGS. 16 and 17, show a variation for the cover 112 that includes a plow 140 at a leading edge of the cover 112 in order to provide a clearing action of the track 118 as the cover 112 moves within a track 118. In the implementation of FIG. 16, the wheels 122 of the cover 112 engage the tracks 118 of the opposing sideboards 114. As will be appreciated, following loading or unloading operations pieces 127 of bulk material may remain on the track 118. In this regard, it may be advantageous to provide a mechanism for clearing the pieces 127 from the track 118 ahead of the cover 112 in order to help facilitate smooth movement of the cover 112 in the tracks 118. The plow 140 is provided at the leading edge of the cover 112 such that movement from the open to closed position directs the plow ahead of the cover 112 in order to clear the track 118 of some or all of the pieces 127 of bulk material or of other debris such as for example ice or snow. The plow 140 may generally be in the shape of a wedge with side plow portions 142 disposed near the lateral ends of the plow 140. The side plow portions 142 have angled surfaces in order to provide a clearing action to push particles 127 away from the track 118 and toward the center of the plow 140. In operation, as the cover 112 is moved from the open to closed position, the plow 140 at the leading edge of the cover 112 clears some or all of the pieces 127 of bulk material that might be disposed in the tracks 118. FIG. 17 shows pieces 127 of bulk material that have been dislodged from the tracks 118 by the side plow portions 142. Also, if bulk material after loading a freight car was to extend above the level of the track 118, the plow 140 would shear off the top of the excess bulk material.

Figure 18:
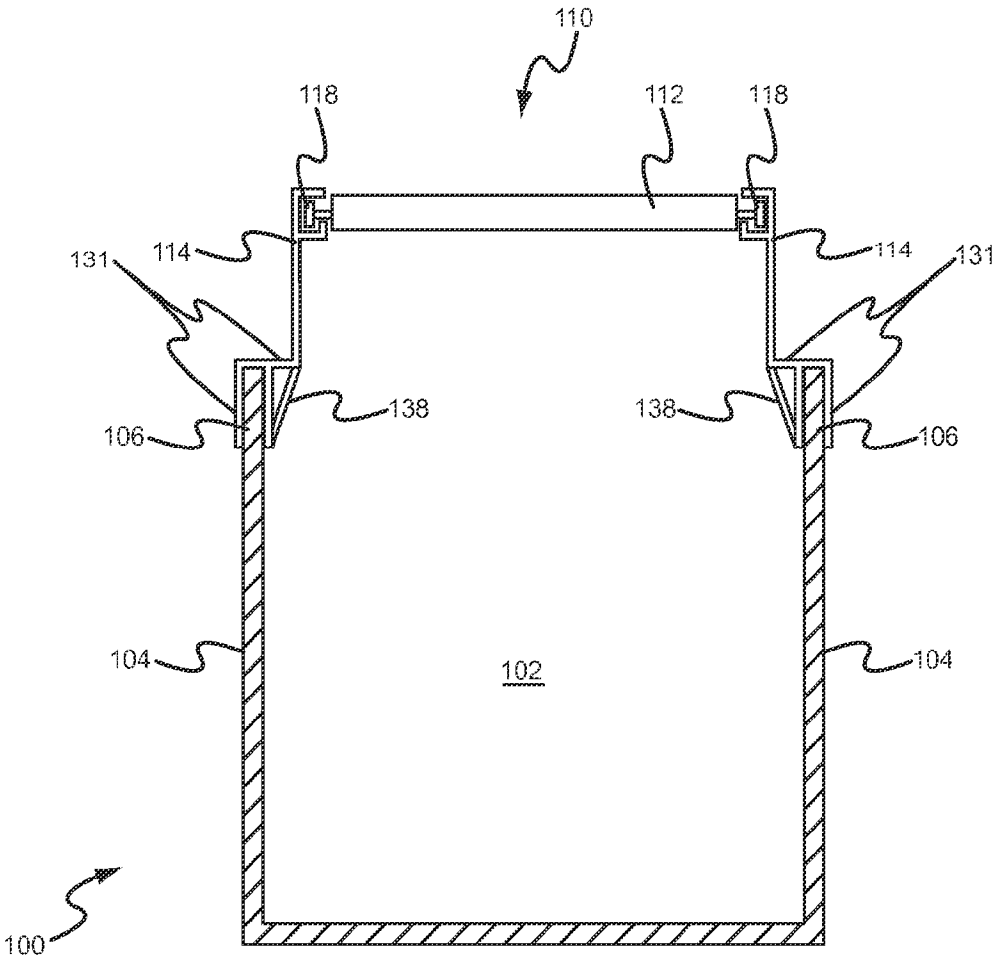
FIG. 18 is a cross-sectional end view of one embodiment of a rail car with a rail car cover.
Figure 19:
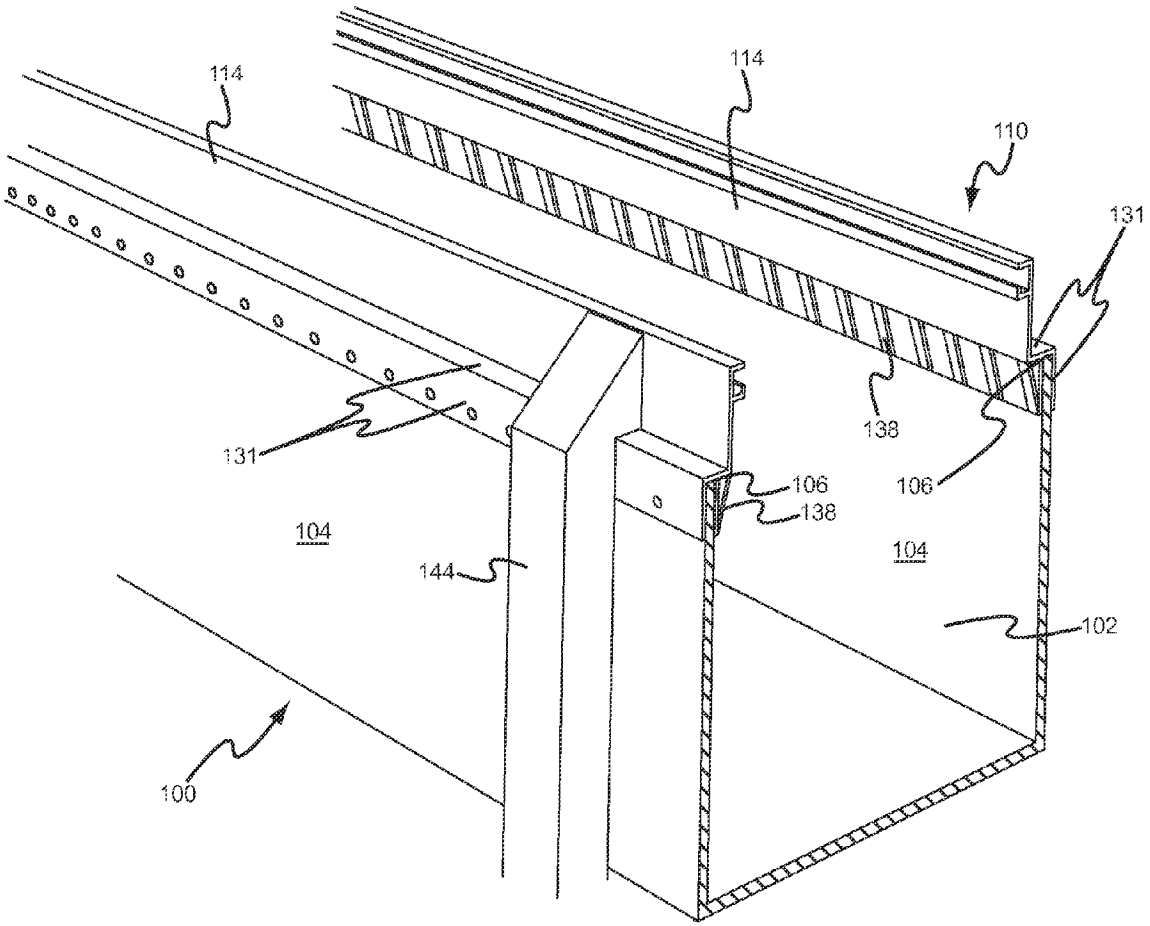
FIG. 19 is a cutaway perspective view of the rail car embodiment of FIG. 18.

FIGS. 18 and 19 show a variation for implementation of the cover assembly 110. FIG. 18 is a sectional view across the width of the containment structure of the rail car 100 taken at a point along the length of the rail car 100. As shown in FIGS. 18 and 19, the sideboards 114 are laterally offset toward the middle of the freight car 110 relative to the sidewalls 104. This configuration is well-adapted for some rotary dump applications, in which the rotary dump mechanism clamps against the outside of the sidewalls 104 of open-top freight cars and over the top edges 106 of the sidewalls 104. The clamps thus hold a freight car in place while the rotary dump structure is rotated to effect a rotary dump of the freight car. With continued reference to FIGS. 18 and 19, the offset of the sideboards 114 relative to the sidewalls 114 permits clamps of a rotary dump mechanism to engage the shoulder portions 131 of the sideboards, instead of directly engaging the sidewalls 104. However, the offset of the sideboards 114 over the containment volume 102 should be kept small enough so that the sideboards do not obstruct loading equipment during loading operations. The offset of the sideboards 114 will often not extend over the containment volume 102 by more than an amount selected from the group consisting of 0.5 meter, 0.4 meter, 0.3 meter, 0.2 meter and 0.1 meter.

FIG. 19 shows the rail car 100 held by a clamp 144, such as might be used to help hold the rail car 100 in place for a rotary dump operation. FIG. 19 shows only one clamp 144, although in a typical rotary dump operation, the rail car 100 would be held by multiple clamps engaging the shoulder portions 131 at multiple different locations and on opposing sides of the rail car 100.

As noted, the inset portions of the sideboards 114 may allow for use in conjunction with a rotary dump rail car. It will be appreciated the clamps (e.g., clamp 144 in FIG. 19) may extend a certain distance inboard of the top edges 106, as accommodated by most of the shoulder portions 131 of the sideboards 114. In this light, a clamp of the rotary dump rail car may engage the shoulder portion 131 of a sideboard 114 adjacent to the top edge 106 such that the clamp may exert force downwardly along the sideboard 114 adjacent to the top edge 106. The inboard design of the sideboards 114 allows for the clamps to be positioned adjacent thereto for clamping the rail car assembly 100, along with the cover assembly 110 attached thereto, to a fixture for rotary dump. In alternative implementations, support structures 138 may be provided on the portion of a sideboard 114 adjacent to the sidewall 104 such that a support spans a distance from the sideboard 104 to the sidewall 114. In another alternative implementation, additional support structures may be provided on the sideboard 114 adjacent to the clamps, such that the support structures accommodate passage of the position of the clamp in a clamping engagement with the sideboard 114. It will be appreciated, however that the cover assembly 110 shown in FIGS. 18 and 19 may be used with bottom dump freight cars.

The sideboards 114 of the implementation shown in FIGS. 18 and 19 include an attachment structure that includes channel portions that slip over the top edges 106 of the sidewalls 104 and down along the sides of the sidewalls 104 for some distance. In an alternative implementation, such a channel attachment configuration could be used even without an offset between the sideboards 114 and sidewalls 104, such as, for example, for a bottom dump application. The channel portions may be continuous and extend for substantially the entire length of the sideboards 114, or may be non-continuous to only engage the sidewalls 104 of various locations along the length of the sideboards 114.

In one implementation, a cover may comprise a single piece of reliable cover material that extends substantially over the entire length of the containment volume of the freight car when the cover is in an open position. For example, the cover material of the cover 112 shown in FIG. 14 may be a single piece of polycarbonate material, with laterally extending ribs on the underside that provide added structural strength to the cover, but that also are spaced sufficiently far apart to permit the piece to retract into a roll. In an alternative implementation, the cover may comprise a single piece tarp or other flexible material that rolls into a roll when the cover is retracted into the open position.

The foregoing discussion of the invention has been presented for purposes of illustration and description and to disclose the best mode contemplated for practicing the invention. The foregoing is not intended to limit the invention to only the form or forms specifically disclosed herein. Although the description of the invention has included description of one or more embodiments and certain variations and modifications, other variations and modifications are within the scope of the invention, e.g., as may be within the skill and knowledge of those in the art after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter. Furthermore, any feature described with respect to any disclosed embodiment, implementation, variation or configuration may be combined in any combination with one or more features of any other embodiment, implementation, variation or configuration.

The terms "comprising", "containing", "including" and "having", and variations thereof, are intended to be inclusive and nonlimiting in that the use of such terms indicates the presence of some condition or feature, but not to the exclusion of the presence also of any other condition or feature. Examples of various features have been provided for purposes of illustration, and the terms "example", "for example" and the like indicate illustrative examples that are not limiting and are not to be construed or interpreted as limiting a feature or features to any particular example. For example, specific sideboard and cover structures and disclosed herein are non-limiting. The sideboard may be comprised of one or more than one piece. The cover may be comprised of more or less that the number of pieces shown in any example. In some implementations, the track need not extend for the entire length of the sideboard. The sideboards are illustrated with ramping sections of track on the ends providing for ramping portions of the cover near the longitudinal ends of the containment volume. However such ramping is not necessary. For example the tracks and cover could be at the same elevation at one or both of the longitudinal ends as the elevation of the tracks and cover in intermediate locations. The cover preferably retracts into a roll when the cover is in the open position, but such is not required. Other retractions of the cover are possible. For example, the cover could retract into a receptacle that wraps around the outside of the railroad car or the inside of the containment volume. It will be appreciated that the freight car and cover assembly and features thereof are described herein as they would be when the freight car and cover assembly are oriented for use, i.e., as oriented relative to a railroad car positioned on a rail for use. The sideboards need not be separate units and may be provided in a single unit attachable to an open-top freight car, or may be laterally braced between them across the width of the open top freight car near the longitudinal ends of the sideboards. Although described herein primarily with reference to railroad freight cars, the invention is not so limited and is applicable to other transport vehicles (e.g., trucks, barges) with open-top, containment structures with a top-loading containment volume for containing a bulk commodity during transport. The embodiments presented herein are implementable with other open top containment vessels capable of transporting a bulk material or the like.

What is claimed is:

1. A top-loading railroad freight car for bulk commodity haulage, comprising:

an open-top containment structure to contain a bulk material within a containment volume open at the top to accommodate top-loading of the containment volume, the containment structure comprising vertically-projecting sidewalls disposed on opposing sides of the containment volume, each said sidewall having a top edge;

opposing sideboards attached to the sidewalls, wherein the sideboards project at an elevation of least 0.1 meter higher than the top edges of the sidewalls at least along substantially all of a first portion of a length dimension extending from 3 meters from the first longitudinal end of the containment volume to 3 meters from the second longitudinal end of the containment volume, and wherein the sideboards comprise ramped portions at a first longitudinal end and a second longitudinal end of each of the sideboards that each extend from the elevation of the first portion toward the top edge of the sidewall at a corresponding longitudinal end of the containment structure;

a cover moveable between an open position and a closed position, wherein when the cover is in the open position, access to the containment volume is free of obstructions at least along a majority of a length dimension of the containment volume such that the containment volume is accessible from above to accommodate open-top loading of bulk material, and when the cover is in the closed position at least a majority of the containment volume is covered from above, with the cover being supported by the sideboards above the containment volume with at least a portion of the cover at the elevation at least 0.1 meter higher than the top edges of the sidewalls; and the sideboards comprising tracks that guide movement of the cover between the open and closed positions, wherein the track of each said sideboard extends from at least adjacent a first longitudinal end of the containment volume to adjacent a second longitudinal end of the containment volume, and wherein the cover comprises a plow disposed at a leading edge of the cover that is engaged with the tracks to clear material from the track as the cover is advanced relative to the track;

wherein the track extends along the sideboards a distance laterally offset from the sidewall of the containment structure in a direction inboard toward the center of the containment volume such that a shoulder portion of the sideboard is defined adjacent to the top edge of the sidewall to accept a clamp for engagement of the rail car in connection with rotary dump operation.

2. The top-loading railroad freight car according to claim 1, wherein at least a portion of the track of each said sideboard is at least 0.6 meter higher than the top edge and at least a portion of the cover is at a vertical elevation of at least 0.6 meter higher than the top edges when the cover is in the closed position.

3. The top-loading railroad freight car according to claim 1, wherein the cover comprises a single piece of rollable cover material that extends substantially over an entire length of the containment volume when the cover is in the closed position.

4. The top-loading railroad freight car according to claim 1, wherein a containment volume length dimension is at least 14 meters between a first longitudinal end and a second longitudinal end of the containment volume.

5. A top-loading railroad freight car according to claim 4, wherein the track of each said sideboard extends for at least substantially all of the first portion of the length dimension at a vertical elevation at least 0.7 meter higher than the top edge.

6. The top-loading railroad freight car according to claim 1, wherein substantially all portions of the top edges of the sidewalls are at substantially the same elevation.

7. The top-loading railroad freight car according to claim 1, wherein when the cover is in the closed position, substantially all of the containment volume is covered from above.

8. The top-loading railroad freight car according to claim 1, wherein the sideboards project at least 0.3 meter higher than the top edges of the sidewall and wherein the cover is supported by the sideboards above the containment volume with at least a portion of the cover at an elevation at least 0.3 meter.

9. The top-loading railcar of claim 1, wherein at least a portion the roll is disposed within the containment volume.

10. The top-loading railcar of claim 1, wherein when in the open position, at least a portion of the cover is disposed below the top edge of the sidewall.

11. The top-loading railcar of claim 10, wherein at least a portion of the cover is retained within the track.

12. The top-loading railcar of claim 11, wherein a wheel of the cover is retained within the track.

13. A railroad car cover retrofit assembly adapted for retrofitting a retractable cover to a top-loading railroad freight car for bulk commodity haulage, the railroad freight car having a containment structure to contain a bulk material within a containment volume open at the top to accommodate top loading of the containment structure, the containment structure comprising vertically-projecting sidewalls disposed on opposing sides of the containment volume, each said sidewall having a top edge, the rail car cover retrofit assembly comprising:

opposing sideboards adapted to be attachable to the sidewalls and extending continuously from at least adjacent a first longitudinal end of the containment volume to adjacent a second longitudinal end of the containment volume when the assembly is retrofitted to the railroad freight car, each said sideboard comprising a track having at least a portion at a vertical elevation of at least 0.1 meter higher than the top edges of the sidewalls and extending continuously from at least adjacent a first longitudinal end of the containment volume to adjacent a second longitudinal end of the containment volume when the assembly is retrofitted to the railroad freight car, and wherein the sideboards comprise ramped portions at a first longitudinal end and a second longitudinal end of each of the sideboards that each extend from the elevation of the first portion toward the top edge of the sidewall at a corresponding longitudinal end of the containment structure when the assembly is retrofitted to the railroad freight car;

a cover adapted to be moveable between an open position wherein at least most of the cover retracts into a roll adjacent to one of the first longitudinal end and the second longitudinal end of the containment volume for providing access free of obstructions to the containment volume from above along at least a majority of a length dimension of the containment volume for open-top loading of bulk material and a closed position for substantially covering the containment volume from above, wherein the cover comprises a plow disposed at a leading edge of the cover that is engaged with the tracks to clear material from the track as the cover is advanced relative to the track; and each track engageable with the cover and configured to guide the cover between the open position and the closed position when the cover is moved between the open and the closed position, wherein when the assembly is retrofitted to the railroad freight car with the cover in the closed position, at least a portion of the cover is at an elevation of at least 0.1 meter higher than the elevation of the top edges of the sidewalls;

wherein the track extends along the sideboard a distance laterally offset from the sidewall of the containment structure in a direction inboard toward the center of the containment volume such that a shoulder portion of the sideboard is defined adjacent to the top edge of the sidewall to accept a clamp for engagement of the rail car in connection with rotary dump operation.

14. A sideboard adapted for attachment to a sidewall of a top-loading railroad freight car for bulk commodity haulage, the railroad freight car having a containment structure comprising vertically projecting sidewalls disposed on opposing sides of the containment volume, each said sidewall having a top edge, the sideboard comprising: an engagement portion configured for attachment to the sidewall;

a track supported relative to the engagement structure with at least a portion of the track being disposed at least 0.1 meter higher than the edge of the sidewall when the engagement portion is attached to the sidewall, wherein the track extends along ramped portions at a first longitudinal end and a second longitudinal end of each of the sideboards that each extend from the elevation of the first portion toward the top edge of the sidewall at a corresponding longitudinal end of the containment structure when the engagement portion is attached to the sidewall;

wherein, the track is adapted to engage and guide translation of a moveable cover between first and second ends of the guide track to move the cover between an open position wherein at least most of the cover retracts into a roll adjacent to one of a first longitudinal end and a second longitudinal end of the containment volume and in which the containment volume is free of obstructions from above by the cover along at least a majority of a length dimension of the containment volume, and a closed position in which the containment volume is covered from above by the cover;

wherein the sideboard and the track extend continuously from at least adjacent a first longitudinal end of the containment volume to adjacent a second longitudinal end of the containment volume when the engagement portion is attached to the sidewall; and wherein the cover comprises a plow disposed at a leading edge of the cover that is engaged with the tracks to clear material from the track as the cover is advanced relative to the track.

* * * * *